US006360569B1

(12) United States Patent
Huang

(10) Patent No.: US 6,360,569 B1
(45) Date of Patent: Mar. 26, 2002

(54) LOCK THAT CAN BE LOCKED FROM TWO SIDES THEREOF

(75) Inventor: Lin-Shi Huang, Kaohsiung (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 09/814,848

(22) Filed: Mar. 23, 2001

(51) Int. Cl.[7] ..... E05B 13/10

(52) U.S. Cl. ..... 70/215; 70/224; 70/478; 70/DIG. 60

(58) Field of Search ..... 70/215, 216, DIG. 60, 70/224, 475, 478, 484, 485, 150

(56) References Cited

U.S. PATENT DOCUMENTS

| | | | | | |
|---|---|---|---|---|---|
| 2,998,274 | A | * | 8/1961 | Russell | 70/216 |
| 3,896,644 | A | * | 7/1975 | Nagy et al. | 70/149 |
| 3,896,645 | A | * | 7/1975 | Nagy et al. | 70/149 |
| 4,254,648 | A | * | 3/1981 | Dietrich | 70/380 |
| 4,435,967 | A | * | 3/1984 | Best et al. | 70/224 |
| 4,698,989 | A | * | 10/1987 | Zuckerman | 70/DIG. 42 X |
| 5,177,987 | A | * | 1/1993 | Shen | 70/224 |
| 5,284,372 | A | | 2/1994 | Lin | 292/336.3 |
| 5,372,025 | A | * | 12/1994 | Lin | 70/149 X |
| 5,784,909 | A | * | 7/1998 | Huang | 70/224 |
| 6,216,500 | B1 | * | 4/2001 | Kang | 70/224 |

* cited by examiner

*Primary Examiner*—Lloyd A. Gall
(74) *Attorney, Agent, or Firm*—Bacon & Thomas, PLLC

(57) ABSTRACT

A lock that can be locked from two sides thereof includes a first fixing base combined with a seat plate at one side of the door plate for receiving a securing plate and a restoring spring seat. The restoring spring seat defines a drive hole combined with a drive tube. A first drive shaft tube has one end combined with the restoring spring seat. The first drive shaft tube defines a slot such that a locking plate protrudes from and retract into the slot. A first handle is combined with the other end of the first drive shaft tube. The first handle has a lock whose lock core defines a double sector faced slot into which one end of the first lock control plate is inserted. The other side of the door plate is combined with a second fixing base and a seat plate. The second fixing base defines a shaft hole for passage of a second drive shaft tube. The second drive shaft tube receives a locking cylinder, an elastic member, a cone-shaped plate, and a connecting cylinder, and is combined with a restoring spring seat. The locking cylinder has locking plates that can be locked in the locking grooves or detached from the locking grooves by pressing of the elastic member. The locking cylinder has a bottom defining arc-shaped slots. The cone-shaped plate has cone-shaped wings protruded from the arc-shaped slots or rested on the bottom of the locking cylinder during rotation of the cone-shaped plate.

6 Claims, 5 Drawing Sheets

LOCK THAT CAN BE LOCKED FROM TWO SIDES THEREOF

BACKGROUND OF THE INVENTION

1. Field of the Invention

The present invention relates to a lock that can be locked from two sides thereof, wherein when the lock is installed on the door plate, each of the two sides of the door plate needs a correct key to lock or unlock the lock, without the directional limit of inside or outside.

2. Description of the Related Prior Art

The closest prior art of which the applicant is aware is disclosed in the U.S. Pat. No. 5,284,372. In the said patent, a conventional tubular lock is disclosed, wherein the tubular lock has the directional limit of inside or outside. A correct key is needed to lock or unlock the tubular lock from the outside of the door plate, and a rotation knob is mounted inside of the door plate for locking or unlocking the tubular lock.

SUMMARY OF THE INVENTION

The primary objective of the present invention is to provide a lock that can be locked from two sides thereof. The lock can be used in sites with special requirements, wherein each of the two sides of the door plate needs a correct key to lock or unlock the lock.

In accordance with the present invention, there is provided a lock that can be locked from two sides thereof, comprising: a first fixing base, provided with combination posts combined with a seat plate at one side of the door plate for receiving a securing plate and a restoring spring seat, the securing plate defining a hole whose periphery formed with locking grooves, the restoring spring seat defining a drive hole combined with a drive tube; a first drive shaft tube, having one end passed through a shaft hole defined in the first fixing base and combined with the restoring spring seat, the first drive shaft tube defining a slot such that a locking plate protrudes from and retract into the slot; a first handle, combined with the other end of the first drive shaft tube, a lock mounted in the first handle and having a first end provided with a lock core that can be rotated by a correct key, a first lock control plate having one end inserted into a second end of the lock; a second fixing base, provided with combination posts combined with a seat plate, the second fixing base defining a shaft hole whose periphery formed with locking grooves, a locking cylinder, an elastic member, a cone shaped plate and a connecting cylinder respectively mounted between the second fixing base and the seat plate, the locking cylinder having locking plates that can be locked in the locking grooves or detached from the locking grooves by pressing of the elastic member, the locking cylinder having a bottom defining arc-shaped slots, the cone-shaped plate having cone-shaped wings protruded from the arc-shaped slots or rested on the bottom of the locking cylinder during rotation of the cone-shaped plate, the connecting cylinder mounted between the cone-shaped plate and a restoring spring seat, and having blocks locked in straight slots defined in the locking cylinder; a second drive shaft tube, having one end passed through a shaft hole defined in the second fixing base to receive the elastic member, the cone-shaped plate, and the connecting cylinder, and combined with a restoring spring seat, the elastic member having one end rested on inner blocks mounted in the second drive shaft tube, the connecting cylinder defining a drive hole for passage of the drive tube, the cone-shaped plate defining an elongated hole for passage of the first lock control plate to be driven to rotate; and a second handle, combined with the other end of the second drive shaft tube, a lock mounted in the second handle and having a first end provided with a lock core that can be rotated by a correct key, a second lock control plate having a head placed in a second end of the lock, the second lock control plate defining an elongated hole in which the other end of the first lock control plate is inserted.

Further benefits and advantages of the present invention will become apparent after a careful reading of the detailed description with appropriate reference to the accompanying drawings.

DETAILED DESCRIPTION OF THE PREFERRED EMBODIMENTS

Figure 1A:
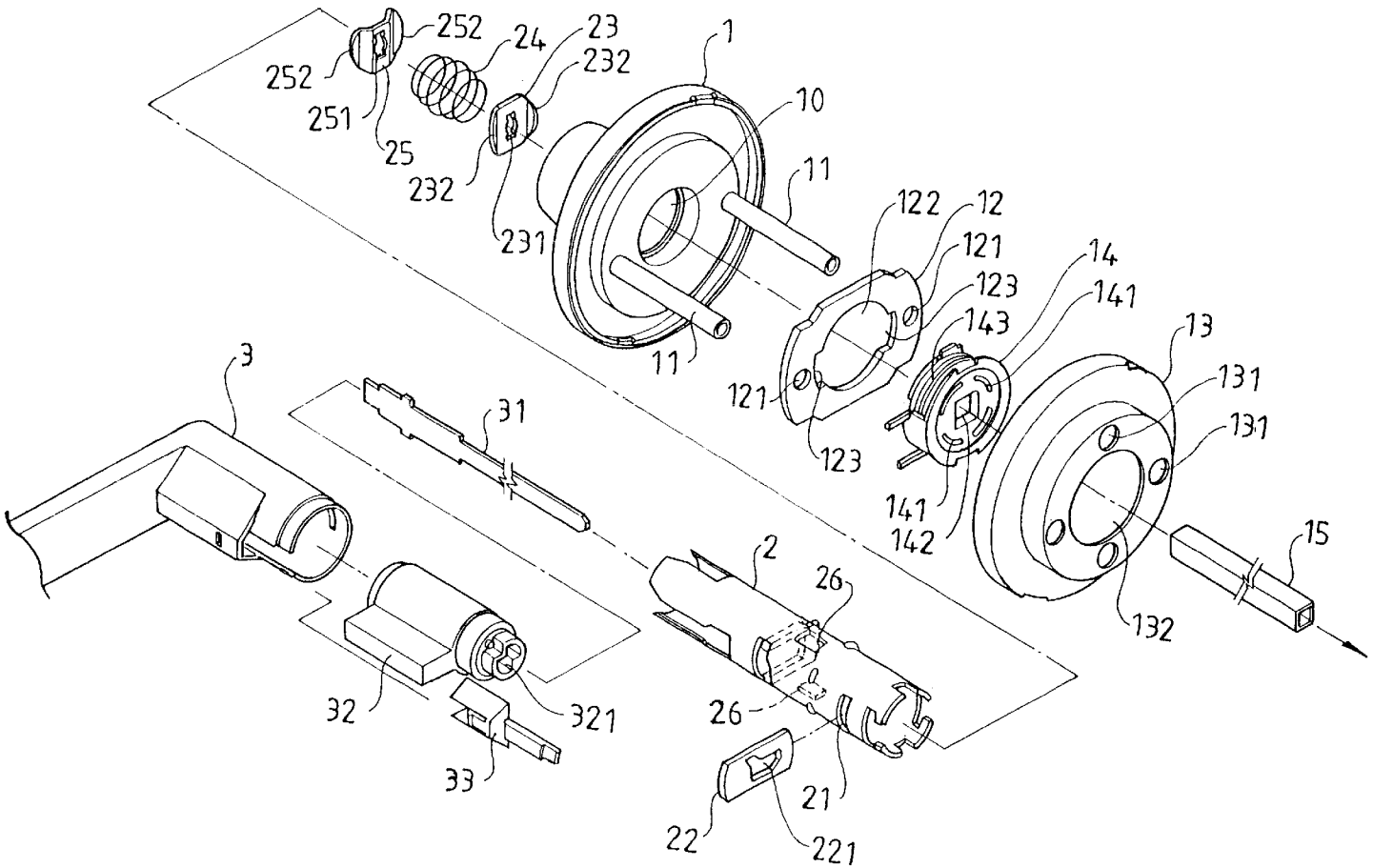
FIG. 1A is an exploded perspective view of a first side of a lock that can be locked from two sides thereof in accordance with the present invention.
Figure 1B:
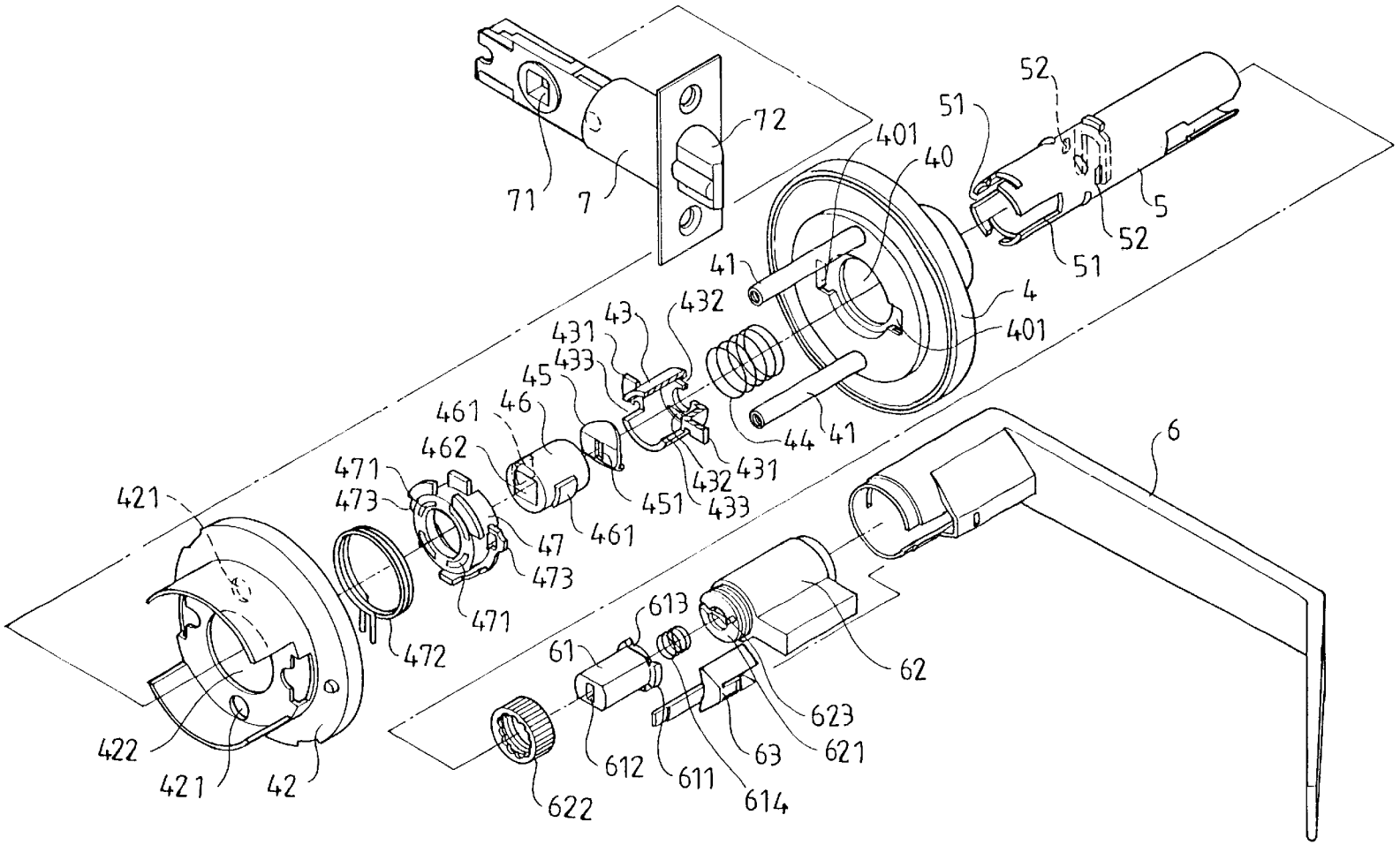
FIG. 1B is an exploded perspective view of a second side of a lock that can be locked from two sides thereof in accordance with the present invention.

Referring to the drawings and initially to FIGS. 1A and 1B, a lock that can be locked from two sides thereof in accordance with the present invention comprises a first fixing base 1, a first drive shaft tube 2, and a first handle 3, which are mounted on one side of the door; and a second fixing base 4, a second drive shaft tube 5, and a second handle 6, which are mounted on the other side of the door.

Referring to FIG. 1A, the first fixing base 1 is provided with combination posts 11 each engaged with a bolt from the other side of the door, so that the first fixing base I is secured on one side of the door. The combination post 11 is fitted with a securing plate 12, a seat plate 13, and a restoring spring seat 14 received in the seat plate 13. The securing plate 12 defines two positioning holes 121 allowing passage of the combination posts 11 of the first fixing base 1, and defines a hole 122 allowing passage and rotation of the first drive shaft tube 2. The periphery of the hole 122 defines two opposite locking grooves 123 whereby a locking plate 22 received in the first drive shaft tube 2 is locked in or detached from the locking groove 123. The seat plate 13 is received in a hole defined in the door, and defines holes 131 allowing passage of the combination posts 11 of the first fixing base 1. The seat plate 13 defines a shaft hole 132 allowing passage and rotation of the first drive shaft tube 2. The restoring spring seat 14 defines slots 141 for combination of one end of the first drive shaft tube 2, and defined a square drive hole 142 for receiving a drive tube 15. The restoring spring seat 14 includes a restoring member 143, such as a spring strip, whose two distal ends protrude to be rested on the combination posts 11. Thus, when the restoring spring seat 14 is rotated by the first drive shaft tube 2, the restoring spring seat 14 can restore the first drive shaft tube 2. The drive tube 15 passes through the drive wheel 71 of the lock bolt 7 to pull the lock tongue 72 of the lock bolt 7 to extend or contract.

The first drive shaft tube 2 passes through the shaft hole 10 of the first fixing base 1, and has one end secured in the slots 141 of the restoring spring seat 14, so that the first drive shaft tube 2 can rotate the restoring spring seat 14. The other end of the first drive shaft tube 2 is secured to the first handle 3 which drives the first drive shaft tube 2 to rotate. The first drive shaft tube 2 defines a slot 21 for receiving the locking plate 22 which defines an operation hole 221 for passage of the lock control plate 31 of the first handle 3. When the lock control plate 31 is rotated, the locking plate 22 is driven to protrude from or retract into the slot 21. The first drive shaft tube 2 receives a press plate 23, an elastic member 24, and a positioning plate 25. The press plate 23 defines an elongated slot 231 whereby the press plate 23 can be rotated by the lock control plate 31 of the first handle 3, so that two protruding sides 232 of the press plate 23 are rested on the locking plate 22, or the two sides 232 are rotated at the two sides of the locking plate 22, so that when one end of the locking plate 22 protrudes from the slot 21, the press plate 23 can support the other end of the locking plate 22. The press plate 23 is pressed by one end of the elastic member 24 whose other end presses the positioning plate 25 which defines an elongated slot 251 for passage of the lock control plate 31. When the lock control plate 31 is rotated, the two sides 252 of the positioning plate 25 can be locked in or detached from the inner blocks 26 provided in the first drive shaft tube 2. Thus, rotation of the lock control plate 31 can be positioned accurately.

The first handle 3 is provided on one side of the door, and is combined with one end of the first drive shaft tube 2, so that the first drive shaft tube 2 can be rotated by the first handle 3. The first handle 3 receives a lock 32 which is secured by a plug 33. One end of the lock core of the lock 32 defines a substantially "8"-shaped double sector faced slot 321 into which one end of the lock control plate 31 is inserted. By provision of the double sector faced slot 321, when the lock control plate 31 is rotated relative to the lock 32, or when the lock core of the lock 32 is rotated by a correct key, an idle stroke is formed therebetween. The lock control plate 31 passes through the press plate 23, the elastic member 24, the positioning plate 25, and the operation hole 221 of the locking plate 22, and has a distal end secured in the lock control plate 61 of the second handle 6. When the lock control plate 31 is rotated to let one end of the locking plate 22 protrude from the slot 21 of the first drive shaft tube 2, the protruding end of the locking plate 22 is locked in the locking groove 123 of the securing plate 12, so that the first drive shaft tube 2 cannot be rotated by the first handle 3, thereby forming a locking state. When the lock control plate 31 is rotated to let the locking plate 22 retract into the slot 21 of the first drive shaft tube 2, the locking plate 22 is detached from the locking groove 123 of the securing plate 12, so that the first drive shaft tube 2 can be rotated by the first handle 3, thereby forming an unlocking state.

Referring to FIG. 1B, the second fixing base 4 is provided with combination posts 41 each engaged with a bolt from one side of the door, so, that the second fixing base 4 is secured on the other side of the door. The combination post 41 passes through a hole 421 defined in the seat plate 42, and the second fixing base 4 and the seat plate 42 respectively define a shaft hole 40 and 422 for rotation of the second drive shaft tube 5. The periphery of the shaft hole 40 defines two opposite locking grooves 401 for locking the two locking plates 431 of the locking cylinder 43. The locking cylinder 43 may be pressed by the elastic member 44, so that the locking plates 431 can detach from the locking grooves 401.

The locking cylinder 43, the elastic member 44, the cone-shaped plate 45, the connecting cylinder 46, and the restoring spring seat 47 are mounted between the second fixing base 4 and the seat plate 42. The restoring spring seat 47 defiles slots 471 for combination of one end of the second drive shaft tube 5, for retaining the locking cylinder 43, the elastic member 44, the cone-shaped plate 45, and the connecting cylinder 46 to be received in the second drive shaft tube 5. The locking cylinder 43 has a bottom defining two opposite arc-shaped slots 432. The locking cylinder 43 receives the cone-shaped plate 45 and the connecting cylinder 46 therein. The cone-shaped plate 45 defines an elongated slot 451 for passage of the lock control plate 31 so that the cone-shaped plate 45 can be rotated by the lock control plate 31. The connecting cylinder 46 is interposed between the cone-shaped plate 45 and the restoring spring seat 47. The connecting cylinder 46 is provided with two blocks 461 received in two straight slots 433 defined in the locking cylinder 43, so that the cone-shaped plate 45 can be maintained to rotate at a determined position. When the two side cone-shaped wings of the cone-shaped plate 45 enter the arc-shaped slots 432 of the locking cylinder 43, the locking cylinder 43 is pressed by the elastic member 44 to detach the two locking plates 431 from the locking grooves 401 of the second fixing base 4. When the two side cone-shaped wings of the cone-shaped plate 45 are rested on the bottom of the locking cylinder 43, the locking cylinder 43 is pushed toward the elastic member 44 so that the locking plates 431 are locked in the locking grooves 401 of the second fixing base 4. Thus, the locking cylinder 43 can stop rotation of the second drive shaft tube 5, thereby forming a locking state. The two locking plates 431 of the locking cylinder 43 pass through the straight slots 51 of the second drive shaft tube 5 to lock in the locking grooves 401. The connecting cylinder 46 defines a drive hole 462 securing the drive tube 15 therein. The connecting cylinder 46 is provided with two blocks 461 received in the two straight slots 433 defined in the locking cylinder 43. The restoring spring seat 47 defines slots 471 for combination of one end of the second drive shaft tube 5. The restoring spring seat 47 is provided with a restoring member 472, such as a spring strip, which is retained Joy the lugs 473, and whose two distal ends protrude to be rested on the combination posts 41. Thus, when the restoring spring seat 47 is rotated by the second drive shaft tube 5, the restoring spring seat 47 can restore the second drive shaft tube 5.

The second drive shaft tube 5 passes through the shaft hole 40 of the second fixing base 4, and has one end secured in the slots 471 of the restoring spring seat 47, so that the restoring spring seat 47 is rotated by the second drive shaft tube 5. The other end of the second drive shaft tube 5 is secured to the second handle 6, so that the second drive shaft tube 5 is rotated by the second handle 6. The second drive shaft tube 5 receives the locking cylinder 43, the elastic member 44, the cone-shaped plate 45, and the connecting cylinder 46 therein, and defines straight slots 51 for receiving the locking plates 431 of the locking cylinder 43. The elastic member 44 has one end rested on inner blocks 52 mounted in the second drive shaft tube 5. When the second drive shaft tube 5 is rotated by the second handle 6, the locking cylinder 43 is rotated by the second drive shaft tube 5 to rotate the connecting cylinder 46, so that the drive tube 15 secured in the drive hole 462 is rotated, thereby rotating the drive wheel 71 of the lock bolt 7 to pull the lock tongue 72 of the lock bolt 7 to extend or contract.

The second handle 6 is provided on one side of the door, and is combined with one end of the second drive shaft tube 5, so that the second drive shaft tube 5 can be rotated by the second handle 6. The second handle 6 receives a lock 62 which is secured by a plug 63. One end of the lock 62 is formed with a screw portion 621 and a stub 623. A nut 622 is screwed on the screw portion 621, and the head 611 of a lock control plate 61 is placed in the nut 622, so that the head 611 is retained to rotate in the nut 622. An elastic member 614 is mounted between the head 611 and the lock core for pressing the head 611 so that the lock control plate 61 is rested in the nut 622 and will not rotate freely due to vibration. Thus, during assembly, the lock control plate 31 is easily inserted into the elongated hole 612. The head 611 defines a cutout 613 for passage of the stub 623 of the lock 62. Thus, when the lock control plate 61 is rotated relative to the lock 62, or when the lock core of the lock 62 is rotated by a correct key, an idle stroke is formed between the stub 623 and the head 611.

Figure 2:
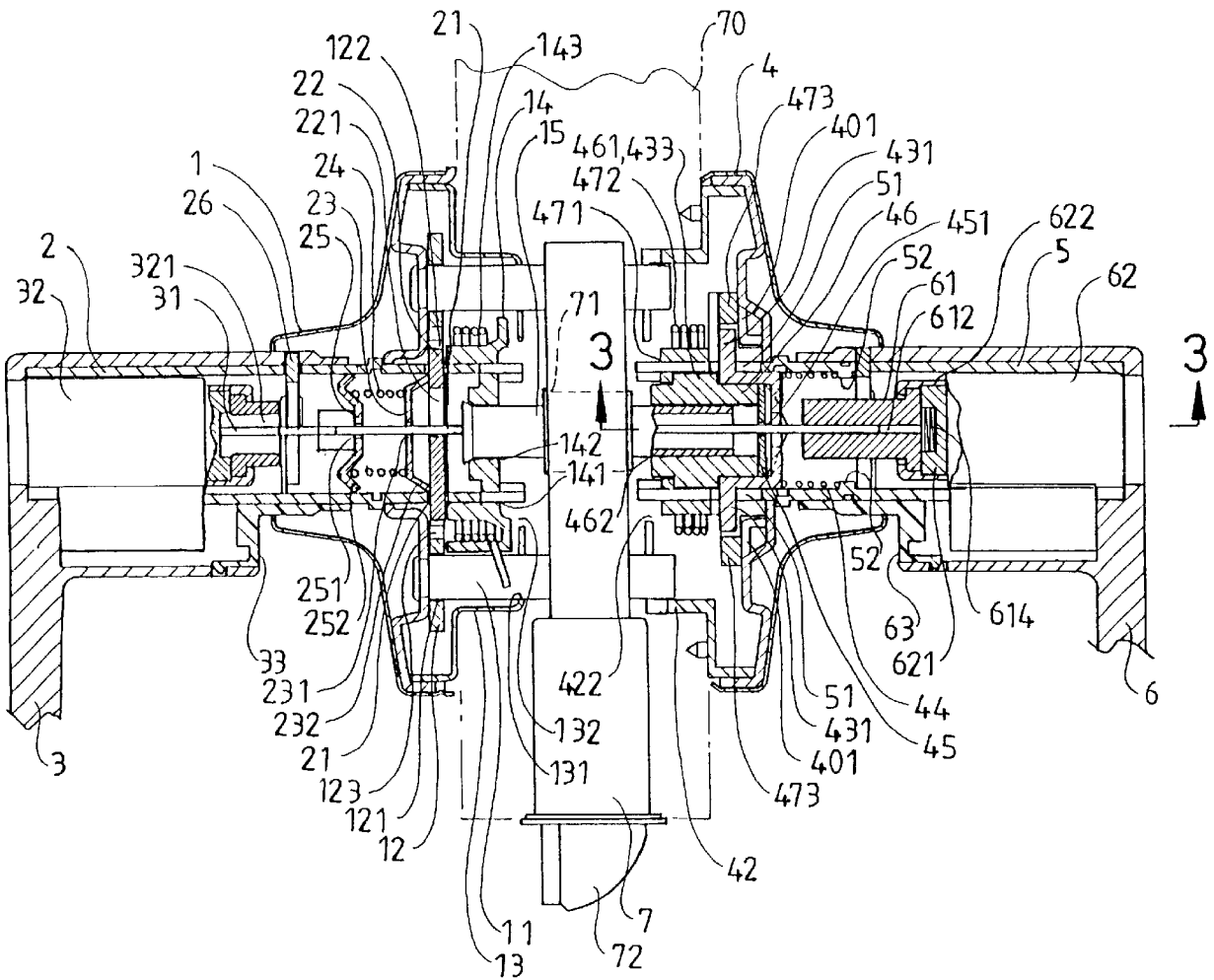
FIG. 2 is a front plan cross-sectional assembly view of the lock that can be locked from two sides thereof in accordance with the present invention.
Figure 4:
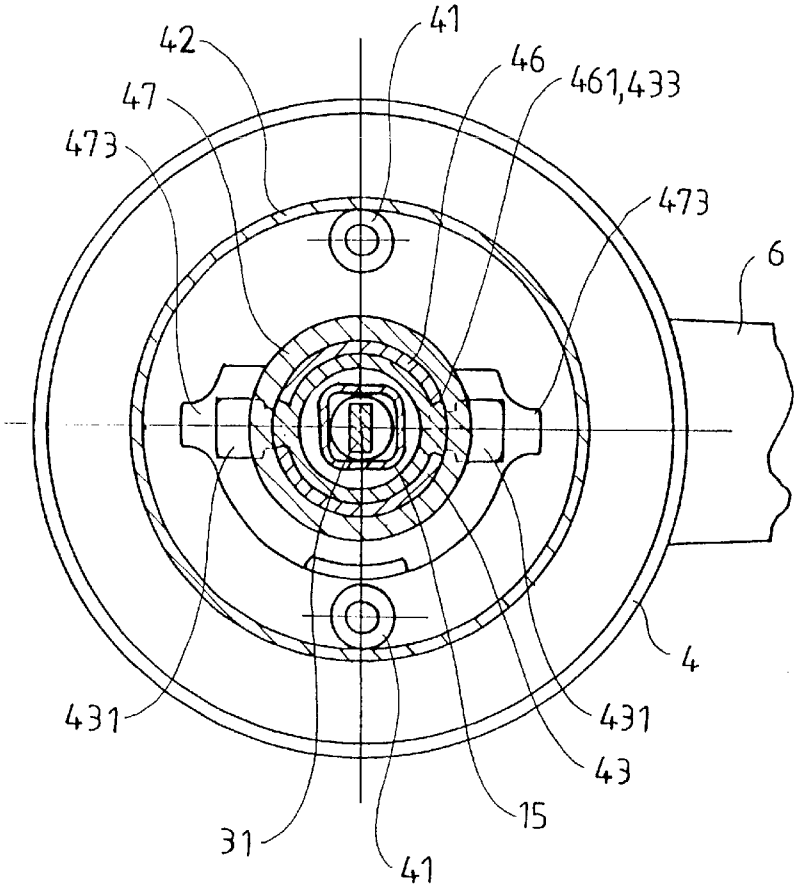
FIG. 4 is a cross-sectional view of the lock that can be locked from two sides thereof along the line 4—4 as shown in FIG. 3.
Figure 3:
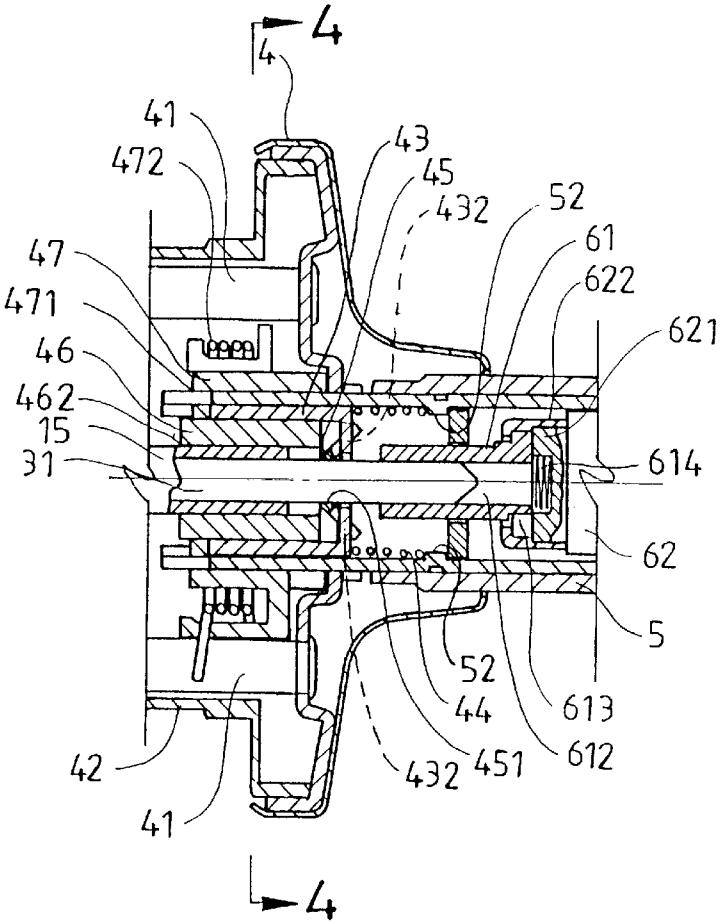
FIG. 3 is a cross-sectional view of the lock that can be locked from two sides thereof along the line 3—3 as shown in FIG. 2.

Referring to FIG. 2, the first fixing base 1, the first drive shaft tube 2, and the first handle 3 are mounted on one side of the door plate 70, and the second fixing base 4, the second drive shaft tube 5, and the second handle 6 are mounted on the other side of the door plate 70. The door plate 70 has the lock bolt 7 whose drive wheel 71 is secured with the drive tube 15. One end of the lock control plate 31 is locked in the double sector faced slot 321, and the other end of the lock control plate 31 is secured in the elongated hole 612 of the lock control plate 61. The lock control plate 31 is not rotated and is disposed at an unlocking state. The locking plate 22 is detached from the locking groove 123 of the securing plate 12. The two side cone-shaped wings of the cone-shaped plate 45 protrude from the arc-shaped slots 432 of the locking cylinder 43 (see FIGS. 3 and 4). Thus, the locking cylinder 43 is pressed by the elastic member 44 to detach the two locking plates 431 from the locking grooves 401 of the second fixing base 4. Therefore, the first handle 3 and the second handle 6 located at the two sides of the door plate 70 are disposed at an unlocking state and can be rotated. When the first handle 3 and the second handle 6 are rotated, the drive tube 15 cart be rotated by the first drive shaft tube 2 or the second drive shaft tube 5, thereby rotating the drive wheel 71 of the lock bolt 7 to pull the lock tongue 72 of the lock bolt 7 to extend or contract.

Figure 5:
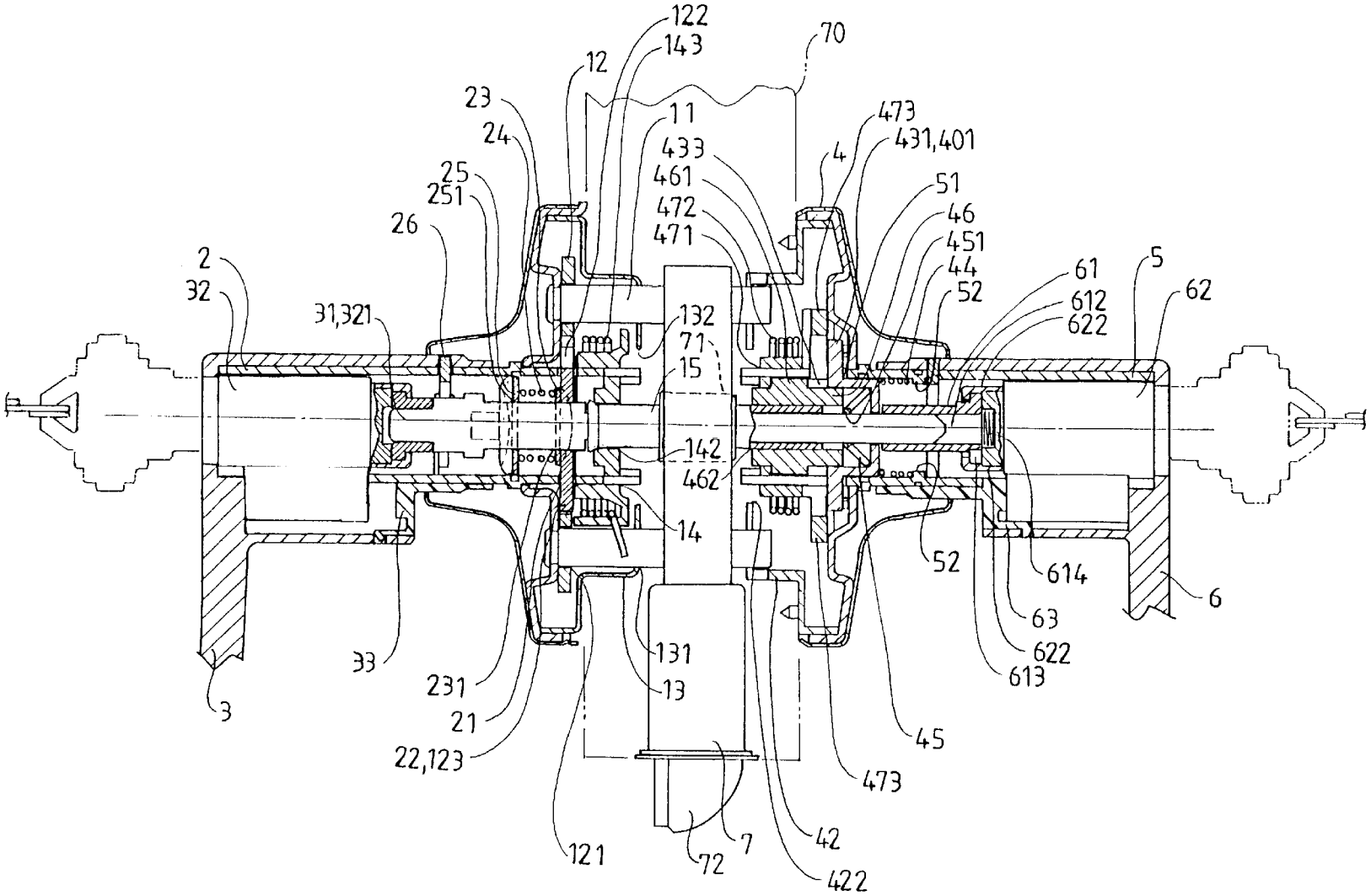
FIG. 5 is a schematic operational view of the lock that can be locked from two sides thereof as shown in FIG. 2.

Referring to FIG. 5, the door plate 70 is disposed at a locked state. The lock control plate 31 is rotated about 90 degrees to lock the door plate 70.

When a correct key is inserted into the lock core of the lock 32 at one side of the door plate 70, the lock control plate 31 can be rotated about 90 degrees. The locking plate 22 is pressed by the lock control plate 31 to protrude from the slot 21 of the first drive shaft tube 2, to be locked in the locking groove 123 of the securing plate 12. At the same time, the cone-shaped plate 45 is rotated by the lock control plate 31. The cone-shaped plate 45 is rested on the connecting cylinder 4.6 and the restoring spring seat 47, so that the cone-shaped plate 45 cannot move backward. The locking cylinder 43 is retained by the second fixing base 4 so that it cannot be rotated. Thus, rotation of the cone shaped plate 45 will cause the two side cone-shaped wings of the cone-shaped plate 45 to rest on the bottom of the locking cylinder 43. Thus, rotation of the cone-shaped plate 45 will push the locking cylinder 43 to displace toward the second fixing base 4, so that the locking plates 431 are locked in the locking grooves 401 of the second fixing base 4. In such a manner, the locking plate 22 is locked in the locking groove 123 of the securing plate 12, while the locking plates 431 are locked in the locking grooves 401 of the second fixing base 4, so that the first drive shaft tube 2 and the second drive shaft tube 5 cannot be rotated. Thus, the locks at the two sides of the door plate 70 form a locking state. When the lock 32 is locked by the correct key driving and rotating the lock core, the lock control plate 61 has a cutout 613, so that when the lock control: plate 31 is rotated, the head 611 of the lock control plate 61 is not directly pressed on the stub 623 of the lock 62. Thus, the lock core of the lock 62 is still not rotated. Only the lock control plate 61 is rotated, and the head 611 is rotated to be in contact with the stub 623 to be disposed at the state to be unlocked along the reverse direction. Therefore, under the locking state, when the correct key is inserted into the lock 32 or 62, the lock core can be rotated to drive the lock control plate 31 to rotate for unlocking the lock.

Alternatively, when the correct key is inserted into the lock 62 to rotate the lock core, the stub 623 on the lock core presses the head 611 of the lock control plate 61 which rotates the lock control plate 31 about 90 degrees. At the same time, the cone-shaped plate 45 is rotated by the lock control plate 31 so that the cone-shaped plate 45 is rested on the bottom of the locking cylinder 43. Thus, rotation of the cone-shaped plate 45 will push the locking cylinder 43 to displace toward the second fixing base 4, so that the locking plates 431 are locked in the locking grooves 401 of the second fixing base 4. At the same time, the locking plate 22 is pressed by the lock control plate 31 to protrude from the slot 21 of the first drive shaft tube 2, to be locked in the locking groove 123 of the securing plate 12. Thus, the first drive shaft tube 2 and the second drive shaft tube 5 cannot be rotated by the first handle 3 or the second handle 6, so that the first handle 3 and the second handle 6 at the two sides of the door plate 70 cannot be rotated, thereby forming a locking state. In addition, when the correct key is inserted into the lock 62 to rotate the lock core, the lock control plate 31 is inserted into the double sector faced slot 321 of the lock 32, so that when the lock control plate 31 is rotated, it can idle about 90 degrees in the double sector faced slot 321. Thus, the lock core of the lock 32 is still not rotated. Only the lock control plate 31 is rotated, to be disposed at the state to be unlocked along the reverse direction. Therefore, under the locking state, When the correct key is inserted into the lock 32 or 62, the lock core can be rotated to drive the lock control plate 31 to rotate for unlocking the lock.

The lock that can be locked from two sides thereof in accordance with the present invention can be used in the sites with special requirements, wherein each of the two sides of the door plate needs a correct key to lock or unlock the lock. In addition, when locking, the two sides of the door plate need to be locked simultaneously, thereby having a better strength for resisting the breaking force.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A lock that can be locked from two sides thereof, comprising:

a first fixing base, provided with combination posts combined with a seat plate for receiving a securing plate and a restoring spring seat, the securing plate defining a hole whose periphery is formed with locking grooves, the restoring spring seat defining a drive hole combined with a drive tube;

a first drive shaft tube, having one end passed through a shaft hole defined in the first fitting base and combined with the restoring spring seat, the first drive shaft tube defining a slot such that a locking plate protrudes from and retracts into the slot;

a first handle, combined with the other end of the first drive shaft tube, a lock mounted in the first handle and having a first end provided with a lock core that can be rotated by a correct key, a first lock control plate having one end inserted into a second end of the lock;

a second fixing base, provided with combination posts combined with a seat plate, the second fixing base defining a shaft hole whose periphery is formed with locking grooves, a locking cylinder, an elastic member, a cone-shaped plate and a connecting cylinder respectively mounted between the second fixing base and the seat plate, the locking cylinder having locking plates that can be locked in the locking grooves or detached from the locking grooves by pressing of the elastic member, the locking cylinder having a bottom defining arc-shaped slots, the cone-shaped plate having cone-shaped wings protruded from the arc-shaped slots or rested on the bottom of the locking cylinder during rotation of the cone-shaped plate, the connecting cylinder mounted between the cone-shaped plate and a restoring spring seat, and having blocks locked in straight slots defined in the locking cylinder;

a second drive shaft tube, having one end passed through a shaft hole defined in the second fixing base to receive the elastic member, the cone-shaped plate, and the connecting cylinder, and combined with the second restoring spring seat, the elastic member having one end rested on inner blocks mounted in the second drive shaft tube, the connecting cylinder defining a drive hole for passage of the drive tube, the cone-shaped plate defining an elongated hole for passage of the first lock control plate to be driven to rotate; and a second handle, combined with the other end of the second drive shaft tube, a lock mounted in the second handle and having a first end provided with a lock core that can be rotated by a correct key, a second lock control plate having a head placed in a second end of the lock, the second lock control plate defining an elongated hole in which the other end of the first lock control plate is inserted.

2. The lock that can be locked from two sides thereof as claimed in claim 1, wherein the first drive shaft tube receives a press plate, an elastic member, and a positioning plate, each of the press plate and the positioning plate defining an elongated hole for passage of the first lock control plate to be driven to rotate, the press plate having sides that can be rested on the locking plate or placed at two sides of the locking plate.

3. The lock that can be locked from two sides thereof as claimed in claim 2, wherein the positioning plate has sides, and the first drive shaft tube has inner blocks, so that when the positioning plate is rotated, the sides of the positioning plate can be locked in or detached from the inner blocks of the first drive shaft tube.

4. The lock that can be locked from two sides thereof as claimed in claim 1, wherein one end of the lock core of the lock of the first handle defines a double sector faced slot into which one end of the first lock control plate is inserted.

5. The lock that can be locked from two sides thereof as claimed in claim 1, wherein the lock of the second handle is provided with a stub and a screw portion, a nut screwed on the screw portion, the head of the second lock control plate is placed in the nut, the head of the second lock control plate defines a cutout so that the stub is pressed on the cutout.

6. The lock that can be locked from two sides thereof as claimed in claim 5, wherein an elastic member is mounted between the head of the second lock control plate and the lock core of the lock of the second handle.

* * * * *